US005114369A

United States Patent [19]

Coffey

[11] Patent Number: 5,114,369

[45] Date of Patent: May 19, 1992

[54] WATER SKIER'S SAFETY SYSTEM

[76] Inventor: Donald R. Coffey, 18801 N. 50th Ave., Glendale, Ariz. 85308

[21] Appl. No.: 373,567

[22] Filed: Jun. 30, 1989

[51] Int. Cl.[5] ..... B63C 9/20

[52] U.S. Cl. ..... 411/11; 116/173; 116/209; 441/89

[58] Field of Search ..... 441/11, 16, 17, 18, 441/19, 20, 89, 94; 116/173, 174, 175, 209, 210

[56] References Cited

U.S. PATENT DOCUMENTS

| | | | |
|---|---|---|---|
| 51,971 | 1/1866 | Rousseil | 441/89 |
| 692,278 | 2/1902 | Hamberg et al. | 441/89 |
| 1,174,594 | 3/1916 | McGiff | 441/89 |
| 1,288,060 | 12/1918 | Le Duc | 116/173 |
| 1,484,485 | 2/1924 | Frear | 116/173 |
| 2,361,414 | 10/1944 | Ramsey | 441/89 |
| 3,105,459 | 10/1963 | Conn | 441/11 |
| 3,599,599 | 8/1971 | Jones | 116/173 |
| 3,760,441 | 9/1973 | Handelman | 441/11 |
| 3,946,699 | 3/1976 | Mirshak | 116/174 |
| 4,144,606 | 3/1979 | McIntyre | 441/11 |
| 4,475,476 | 10/1984 | Howard | 441/20 |
| 4,560,356 | 12/1985 | Burr | 441/94 |
| 4,598,661 | 7/1986 | Roe | 116/173 |
| 4,752,264 | 6/1988 | Melendez et al. | 116/173 |

*Primary Examiner*—Sherman Basinger
*Assistant Examiner*—Thomas J. Brahan
*Attorney, Agent, or Firm*—James F. Duffy

[57] ABSTRACT

A water safety system to be carried on the person of a water skier. The water safety system occupies a minimal packing envelope and includes a signal flag borne by an extendable flag pole. The flag and flag pole assembly are readily accessible to the skier and permit rapid display of the signal flag when a skier enters the water. Weighted floatation devices maintain the signal flag displayed above the water when the pole is unattended.

9 Claims, 1 Drawing Sheet

WATER SKIER'S SAFETY SYSTEM

BACKGROUND

1. Field of the Invention

The invention relates to a water safety system for use by water-skiers. In particular, the invention relates to signaling means to be utilized by a water-skier who is down in the water. Specifically, the invention relates to a safety flag to be carried by a water-skier and displayed by the skier to alert oncoming boats and the like that the skier is down in the water.

2. Prior Art

Water-skiing becomes more popular every year. In the course of pursuing the sport, a power boat tows a skier across the water at such speeds as to permit the skis of the skier to skim over the surface of the water. A competent skier will frequently draw the attention of persons in the vicinity of the activity. A skier, skimming the water surface, is easily seen. However, should the skier lose hold of the tow rope or otherwise lose her balance, she will immediately sink into the water to be supported by her life jacket which maintains her head and possibly part of her shoulders above water.

While it is relatively easy to discern a skier skimming the water, it is another problem altogether to locate a skier down in the water. Safety rules require that the tow boat have an individual whose only task is to maintain sight of the skier. Thus, if the skier goes down into the water, that person may direct the boat back to the site at which the skier went into the water. There is no requirement that all other boats maintain lookout for skiers and their progress. Normal safety provisions must be complied with so as to avoid endangering a skier, however, a person piloting a boat in the vicinity is not held responsible for observing a water-skier as the skier slips down into the water. The person piloting the boat is expected to watch for obstacles in the water so as not to harm his own boat or to injure a swimmer. But, it is not unusual that a swimmer or skier down in the water shall be run over by a passing boat. It is readily understood that a swimmer is in danger of being knocked unconscious, drowned, or mangled by a boat's propeller should the path of a boat and a swimmer cross.

The danger was recognized as early as 1963 when U.S. Pat. No. 3,106,184 was issued to Shea who disclosed a water-ski safety cap, a head covering from which projected an upright shaft and a pennant shaped plate. A somewhat similar head covering was disclosed by Levy, et al. in U.S. Pat. No. 3,213,823 issued in October of 1965. Levy made provision for the upright shaft to fold downward into a generally horizontal position with respect to the upright skier. His shaft was tapered and was also provided with a pennant shaped plate.

In 1988, Melendez, et al. were issued a U.S. Pat. No. 4,752,264 which disclosed a warning flag which was coupled to a skier's life jacket at the center rear thereof. A long flexible mast extended upward from the life jacket a substantial distance beyond the highest point of the skier's head and terminated in a flexible flag. When the skier went down into the water this flag was visible some distance above the skier's head.

All three of the inventions noted display a potentially dangerous characteristic. Each provides the skier with an extended shaft or mast which, in the case of a bad spill, could cause physical damage to the skier and, in the case of a collision between skiers, could conceivably puncture the body of the other skier causing severe injury or even death. The plate-like pennants of Levy and Shea could prove to be potential weapons of destruction as well.

It is the intention of the present invention to offer the water-skier a safety system for signaling the skier's position in the water which safety system may be carried by the skier in a small convenient package, with the signal flag undisplayed but readily available to the skier at any time and particularly when the skier has gone down into the water. The small package of the safety system provides no hindrance to the skier and offers no danger to the skier or others as might be derived from the extended shafts and pointed rigid pennants of the prior art.

SUMMARY OF THE INVENTION

The invention is a water-skier safety system. In a first aspect the system may be considered an improvement on existing safety systems which comprise a signal flag, a pole which bears that flag and means for carrying the flag and the pole which are coupled to the water-skier. The improvement lies in the fact that the pole is extendable from a minimal, transporting dimension to a maximum, flag displaying dimension. Also, the means for carrying the flag and the pole has a quick release means which allows the releasable transporting of the pole, in its minimal transporting dimension, and the flag, undisplayed, so as to present a safety system packaging envelope of a small enough size so as to preclude presentation of dangers to a water-skier and to others as will occur when a water-skier carries an extended flag pole shaft with a flag displayed while water-skiing.

In the improvement the means for carrying the flag and pole has strap engaging means. There are straps coupled to these strap engaging means so as to couple the carrying means itself to at least one of a life jacket and to a part of a skier's body, for example, an arm or a leg.

A further safety feature adds to the improvement. Part of the extendable flag pole comprises a floatation chamber which has a weight therein. The affect of the weight within the floatation chamber is such that the pole will float on a generally longitudinally upright position when in the water.

In terms of apparatus, the invention may be summarized as a water safety system for water-skiers which comprises an extendable flag pole, the pole being unextended. There is a signal flag furled about and coupled to the unextended flag pole. The flag and pole are coupled to a carrier and there are means for coupling the carrier to a water-skier for ease of transport by the water-skier.

There are quick disconnected means on the carrier for rapidly decoupling the flag and the pole from the carrier. In this way a water-skier, who goes down in the water, may rapidly extend the pole and unfurl the flag so as to signal the skier's position in the water.

A DETAILED DESCRIPTION OF THE INVENTION

Figure 1:
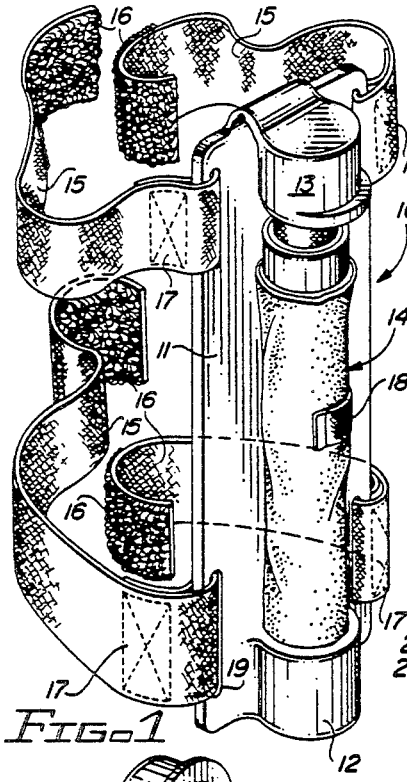
FIG. 1 is a perspective drawing of the water safety system for a water-skier illustrating the compact packaging of the safety flag and its pole and the holster by which the system is carried about the body of a water-skier.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

In devising a water safety system to be used by water-skiers certain system parameters were first predetermined. These parameters considered the dangers which safety flag display systems might present to the skier or to other persons in or on the water. It was first decided that any signaling device, for example, a flag, would not be displayed while the skier was upright and traveling at high speed on the water. At these speeds, a fluttering flag could conceivably adversely affect the skier's balance.

It was also determined that there should be no whips, masts, or other extensions of flag poles or the like carried by the skier to potentially damage the skier or other persons in the water.

The determination was made that the water safety system should occupy a minimal packaging envelope and yet be readily accessible to the water-skier.

The water safety system 10 of the invention is presented in the perspective drawing of FIG. 1. Holster base 11 provides the means for carrying the water safety system on the person. Holster pocket 12 and holster cap 13 provide a quick releasing mechanism which allows rapid access to signal flag assembly 14.

Figure 2:
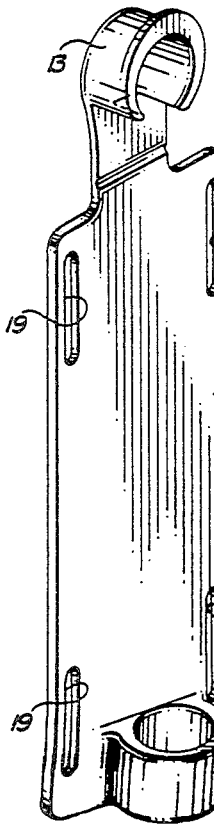
FIG. 2 is a perspective drawing of the means, whereby the safety flag system is transported by the skier illustrating the quick release holster and the means whereby a strap is engaged to maintain the system in position either directly on the body of a water-skier or indirectly by attachment to a life jacket.

As illustrated in FIG. 2, holster base 11 is provided with strap engaging means, here illustrated as elongate openings 19. Elongate openings 19 are intended to accept straps to hold the water safety system in position on the person of a water-skier. The straps employed may be those which normally function to maintain a life jacket in position. Alternatively, the straps employed may be such as to maintain the water safety system attached directly to a limb (arm or leg) or waist of the water-skier.

In the illustration of FIG. 1 short straps 15 are coupled to holster base 11 through elongate openings 19. The straps may be releasably secured by the means of hook and loop type fasteners or permanently coupled as suggested by the stitching 17. Where releasable hook and loop type fasteners are employed, the strapping 15 may be removed from holster base 11 and the existing straps on a life jacket may be employed to couple holster base 11 to the skier's life jacket.

Figure 4:
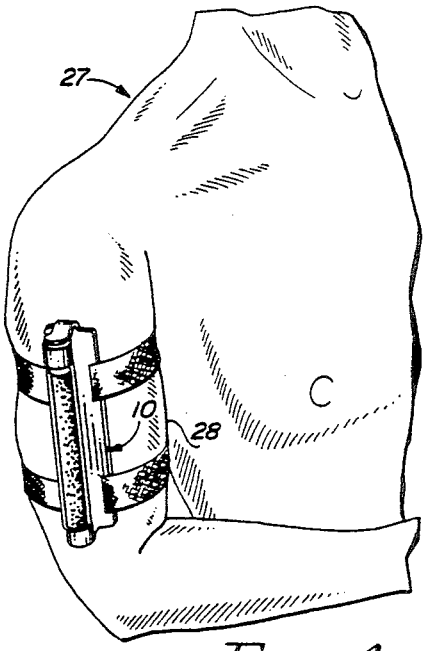
FIG. 4 shows one method of attaching the safety system to the body of a water-skier. Illustrated is the system attached to the upper arm of a skier.

Returning to the configuration of the invention 10 shown in FIG. 1, straps 15 are provided at their ends with complimentary lengths of hook and loop fasteners so that straps 15 may be adjustably loop coupled about a person's limb. This arrangement is illustrated in FIG. 4 wherein the invention 10 is coupled to the upper arm 28 of a person 27.

Figure 3:
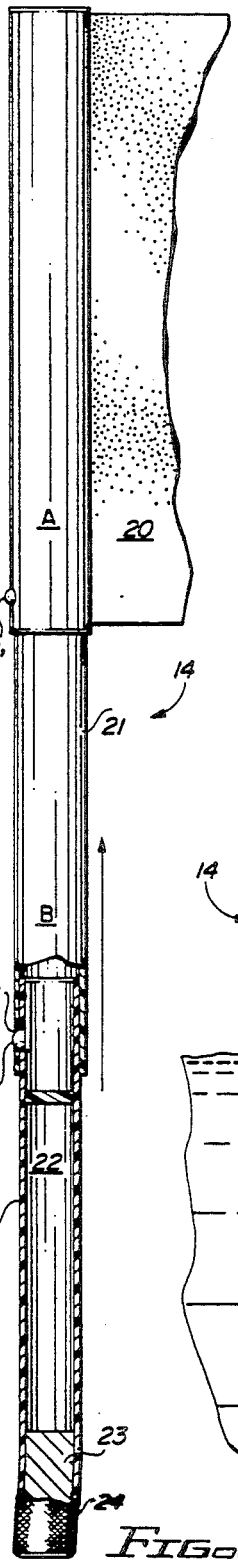
FIG. 3 illustrates a partial cross sectional view of an extendable flag pole as presently preferred for use with the invention. A weighted floatation chamber maintains the untended flag in an upright position in the water.

Flag assembly 14, shown in FIG. 3, is comprised of a signal flag 20 and an extendable flag pole 21. Flag pole 21 may be extended from the minimal transport dimension illustrated in FIGS. 1 and 4 to the display dimension illustrated in FIGS. 3 and 5. The extendable nature of flag pole 21 permits the water safety system 10 to be placed in a minimal sized packaging envelope, as shown in FIGS. 1 and 4, which will not interfere with the activity of the water-skier nor offer danger to the skier or to others the skier may come into contact with.

As seen in FIG. 3, the exemplary embodiment of flag pole 21 there illustrated is comprised of three sections: A, B, and C. When carried by holster base 11, the sections of flag pole 21 are mated one within the other such that C resides within section B and both B and C reside within section A. When the sections are extended, as shown in FIG. 3, spring loaded detente buttons 25 extend outwardly through holes 26 to maintain flag pole 21 in its extended position. The surfaces of flag pole 21 may be treated to provide a non-slip grip as suggested by the scoring 24.

Figure 5:
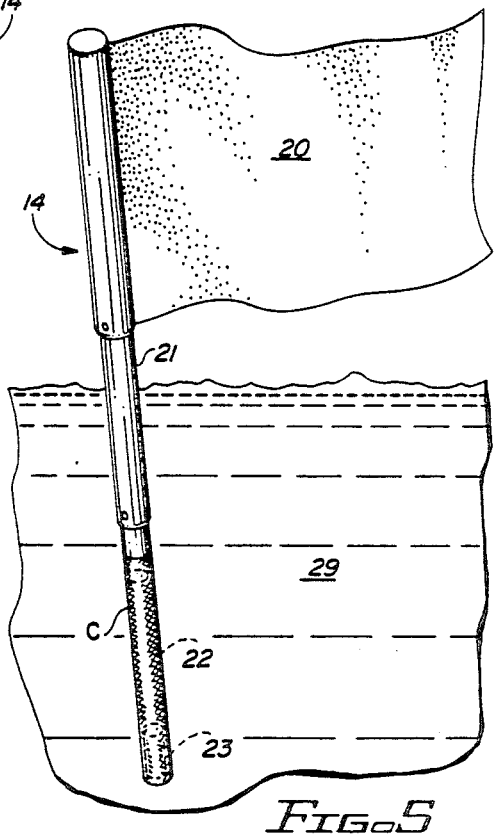
FIG. 5 shows the untended safety flag floating upright in the water.

To prevent inadvertent loss of the flag assembly 14, flag pole section C contains a sealed floatation chamber 22 which is weighted at one end, with weight 23. Weight 23 is so disposed that flag 20 will be displayed from an upright flag pole 21 should the assembly 14 be left unattended in the water. This situation is illustrated in FIG. 5 in which the flag is seen displayed above the surface of water 29 while the combination of floatation chamber 22 and weight 23 maintains flag pole 21 in an upright position.

As seen in FIGS. 1 and 4 the safety system 10 is contained within a minimal packaging envelope. Flag assembly 14 carries the flag furled about the flag pole 21 which is compressed to its minimal extension. A quick release fastener 18, FIG. 1, may also be provided to aid in maintaining the flag in a secure position while the skier moves across the water at high speeds. Upon entering the water the skier merely has to raise holster cap 13 which provides swift and ready access to the flag assembly 14. The sections of flag pole 21 are extended and the flag 20 is rapidly unfurled. The skier may wave the flag above her head to attract attention and to warn off approaching boats. Should the need arise for the skier to dive below the surface or be otherwise involved, the flag assembly 14 may be left unattended where it will float in a generally upright position with the flag displayed above the water.

What has been disclosed is a water safety system to be carried on the person of a water-skier. The water safety system occupies a minimal packaging envelope and includes a signal flag borne by an extendable flag pole. The flag and flag pole assembly are readily accessible to the skier and permit rapid display of the signal flag when a skier enters the water. Weighted floatation devices maintain the signal flag displayed above the water when the pole is unattended.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. A water skier safety system comprising:

a multiple section flag pole, the multiple sections of said flag pole being disposed in a minimal dimension for transport, and joined to form a flag pole of extended length;

a signal flag coupled to said flag pole and furled about said flag pole when said flag pole is in its minimal dimension for transport, and displayed from said flag pole when said flag pole is in its extended length, said flag pole in its extended length being hand manipulatable to wave said pole from the end of a person's arm to display said flag above the head of a person;

a holster base for transporting said flag pole and said signal flag when said base is coupled to the limb of a person;

means coupled to said base for coupling said base to the limb of a person;

a holster pocket coupled to said holster base for carrying said flag pole, in its minimal transport dimension with said furled flag, while said base is coupled to a limb of a person; and quick release means coupled to said holster base for maintaining said flag pole and said flag carried by said holster pocket during transport on a limb of a person and for quickly releasing said flag pole and said flag from said pocket when a person wishes to manipulate said flag pole in its extended length to display said flag.

2. The safety system of claim 1 wherein said means coupled to said base for coupling said base to the limb of a person comprise strap means for encompassing a limb of a person and having means for releasably securing said strap means to a limb of a person.

3. The safety system of claim 2 wherein said means for releasablly securing said strap means to a limb of a person comprise hook and loop fasteners coupled to said strap means.

4. The safety system of claim 1 wherein at least one of the multiple sections of said flag pole comprises a flotation chamber for maintaining said flag pole afloat when unattended in a body of water.

5. The safety system of claim 4 wherein said flotation chamber includes a weighted end so that a portion of said flag pole, when said flag pole is afloat, extends upwards above the surface of the water in which the flag pole is floating.

6. The safety system of claim 5 wherein said means coupled to said base for coupling said base to the limb of a person comprise strap means for encompassing a limb of a person and having means for releasably securing said strap means to a limb of a person.

7. The safety system of claim 6 wherein said means for releasablly securing said strap means to a limb of a person comprise hook and loop fasteners coupled to said strap means.

8. The safety system of claim 4 wherein said means coupled to said base for coupling said base to the limb of a person comprise strap means for encompassing a limb of a person and having means for releasably securing said strap means to a limb of a person.

9. The safety system of claim 8 wherein said means for releasablly securing said strap means to a limb of a person comprise hook and loop fasteners coupled to said strap means.

* * * * *